US005904476A

United States Patent [19]

Hoffman

[11] Patent Number: 5,904,476

[45] Date of Patent: May 18, 1999

[54] CHAFING DISH FUEL CANISTER WITH SNUFFING DEVICE

[75] Inventor: Ross W. Hoffman, Crestwood, Ky.

[73] Assignee: Aaper Alcohol and Chemical Co., Shelbyville, Ky.

[21] Appl. No.: 08/852,655

[22] Filed: May 7, 1997

Related U.S. Application Data

[ 60] Provisional application No. 60/017,436, May 17, 1996.

[51] Int. Cl.[6] ..... F23D 3/26

[52] U.S. Cl. ..... 431/144; 431/320; 431/146

[58] Field of Search ..... 431/33, 34, 88, 431/146, 144, 320

[56] References Cited

U.S. PATENT DOCUMENTS

| | | | |
|---|---|---|---|
| 2,154,618 | 10/1939 | Howard . | |
| 3,885,905 | 5/1975 | Giangiulio . | |
| 4,025,290 | 5/1977 | Giangiulio . | |
| 4,496,307 | 1/1985 | Ginardi . | |
| 4,526,530 | 7/1985 | Menter . | |
| 4,563,150 | 1/1986 | Nilsson | 431/320 |
| 4,887,960 | 12/1989 | Stewart . | |
| 5,660,767 | 8/1997 | Bureau et al. | 431/320 |

*Primary Examiner*—Carl D. Price

*Attorney, Agent, or Firm*—Middleton & Reutlinger; John F. Salazar

[57] ABSTRACT

A chafing dish fuel canister is provided having a snuffing device attached thereto. The chafing dish canister has inserted through the lid an inner sleeve which is securely fitted thereon. The wick extends upwards through the inner sleeve from the canister containing the combustible fuel. Over the top of the inner sleeve is place a reservoir sleeve which is press fitted thereon. Reservoir sleeve has an open outwardly extending reservoir formed at the upper portion thereof for retaining excess fuel not burned during use of the chafing dish fuel canister. Surrounding the reservoir sleeve is a snuffing bowl which is movable along the reservoir sleeve. When the canister is overturned, the reservoir bowl snuffs out the flame. The reservoir sleeve has a annular retention recess for preventing the bowl from snuffing the flame unless the dish is actually overturned. Also, the collection reservoir surrounding the wick allows excess fuel to either be burned or drain back into the canister. Finally, the upper portion of the snuffing bowl extends vertically upwards to allow for easy travel along the reservoir sleeve.

12 Claims, 4 Drawing Sheets

CHAFING DISH FUEL CANISTER WITH SNUFFING DEVICE

BACKGROUND OF THE INVENTION

This application claims the benefit of provisional application Ser. No. 60/017,436, filed on May 17, 1996.

1. Field of the Invention

The present invention relates to food warming devices and in particular to chafing dish fuel canisters which have a snuffing device for extinguishing the flame should the chafing dish fuel canister be overturned.

2. Discussion of the Prior Art

Snuffing devices for lamp assemblies have been around for some time. Typically, a device is provided which causes the flame of the lamp to be extinguished whenever the lamp device is jarred or overturned thereby preventing the flame and combustible material from catching other material on fire. In U.S. Pat. No. 4,025,290 there is disclosed a decorative lamp which has a housing and snuffing device. Snuffer means is provided to ensure the flame is extinguished when the device is turned over. However, this device can cause premature extinguishment of the flame due to the neck design. In addition, in most prior art chafing dish fuel canisters, the wick sleeve can cause the excess combustible material which is not burned to gather at the wick and drip down the sides of the wick neck. U.S. Pat. No. 3,885,905 also teaches a candle and extinguishing means. Similar disadvantages are also found with this device. The flame extinguishing means is not prevented from slipping up the wick neck when the canister may only be jarred nor is there any way for excess combustible material to be drained from the wick area.

SUMMARY OF THE INVENTION

The present invention is for a chafing dish fuel canister having a snuffing device for extinguishment of the flame. One object of the present invention is to provide a chafing dish fuel canister which burns combustible fuel in a safe manner and which has a means for snuffing out the flame should the chafing dish fuel canister be overturned while also preventing the combustible fluid material from being spilled.

More particularly, an object of the present invention is to provide a chafing dish fuel canister which has a snuffing means which will not prematurely extinguish the flame while also providing a design which adequately allows the snuffing bowl to slide along the exterior sleeve surrounding the wick without hindrance. Another object of the present invention is to provide a chafing dish fuel canister which has a reservoir for preventing the collection and spilling of excess combustible material which is not burned by the chafing dish fuel canister wick. Still further, an object of the present invention is to provide a snuffing bowl which easily slides up the wick sleeve in order to extinguish a flame while retaining the snuffing bowl in place when the chafing dish fuel canister is merely jarred while also ensuring that the snuffing bowl readily slides along the wick sleeve when the canister is overturned.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figure 1:
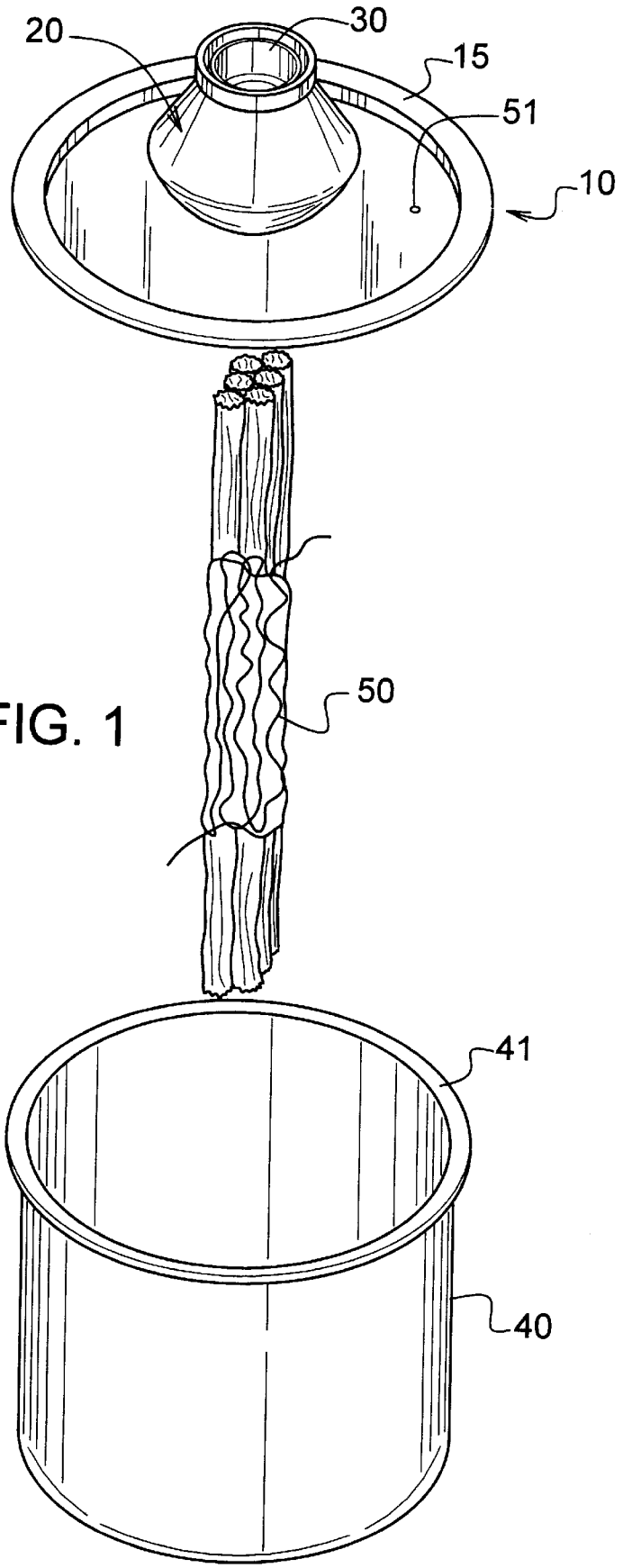
FIG. 1 is a perspective view of the chafing dish fuel canister with snuffing device of the present invention.
Figure 3:
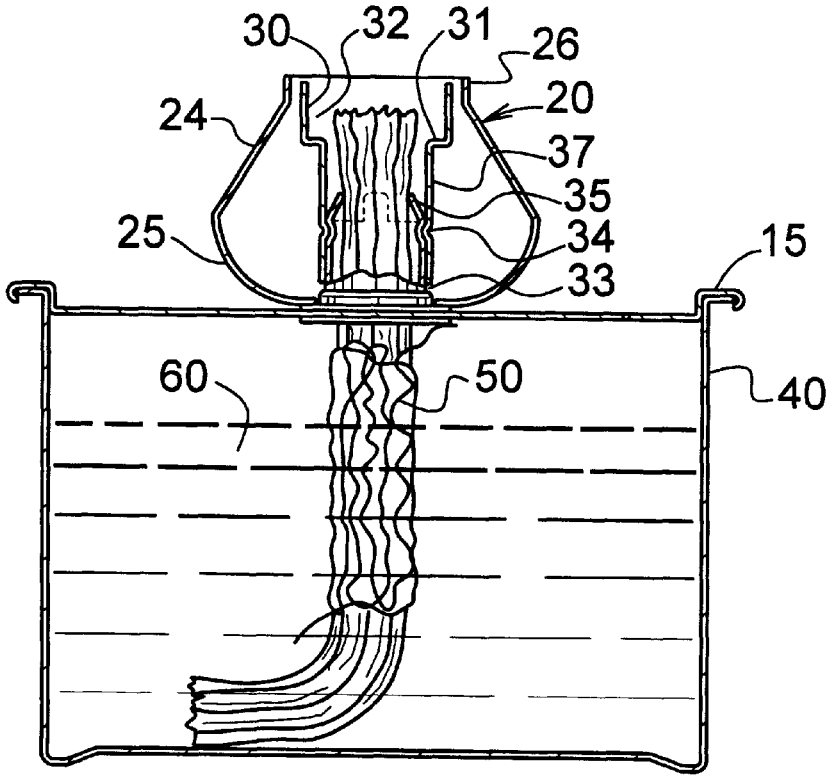
FIG. 3 is a cutaway side view of FIG. 2.

The chafing dish fuel canister 10 of the present invention is shown in FIG. 1 and FIG. 3. The chafing dish fuel canister 10 of the present invention is utilized to heat water in chafing dishes which creates steam thereby warming food held in the chafing dish food pan. Typically, the fuel can 10 is lit underneath the water pan chafing dish and allowed to burn unattended for long periods of time. Lid 15 is shown having attached thereon vertically movable snuffing bowl 20 and reservoir sleeve 30. Wick 50 extends upwards from container 40 which holds combustible fluid material 60. Lid rim 15 is provided for fitting over container rim 41 of canister 40 for a tight seal thereby preventing spillage of combustible fluid 60. Wick 50 extends upwards form container 40 through reservoir sleeve 30 and allows lighting and burning of the combustible material. Snuffing bowl 20 moves vertically along sleeve 30 when the can 10 is overturned thereby extinguishing the flame emitted by wick 50.

Turning to FIG. 3, a cutaway side view of the chafing dish fuel canister of the present invention is shown. Container 40 holds combustible fluid material 60 which is burned via wick 50. The dual sleeves 30 and 35 through which the wick extends is comprised of two separate sleeve elements. Inner sleeve 35 is press fitted onto the lid 15 and extends upwards therefrom providing an access area through which the wick may extend. At the upper portions of inner sleeve 35 are found wick holding prongs 43, 44, 45 and 46, shown in FIG. 2, which hold the wick in place and prevent the wick from sliding downward back into the container 40. Each of prongs 43, 44, 45 and 46 are directed inwards towards the center of the inner sleeve 35 and are also directed upwards at a slight angle. This prevents wick 50 from falling back down into the canister 40 after the lower portion of the wick becomes laden with combustible fluid 60. Wick 50 is a fiberglass wick comprised of six smaller strands of fiberglass wrapped in a fiberglass mesh weave. The top end of the wick is bent over and inserted into the inner sleeve 35 and held in place by prongs 43, 44, 45 and 46. When the container is used, the bottom end of the wick reaches far enough down to touch the bottom of the can enabling the capillary action to use all the fuel 60 until the wick is extinguished.

Secured and slid over the top of inner sleeve 35 is placed reservoir sleeve 30. Reservoir sleeve 30 is crimped over inner sleeve 35 causing crimp indentation 34. After crimping, reservoir sleeve 30 cannot be removed from overlaid attachment to inner sleeve 35. Reservoir sleeve 30 has wider reservoir 32 formed at the upper most portion and a narrower neck portion 37 just below the reservoir 32. Side walls 30 of the reservoir define the widest area within which the wick 50 burns.

Formed at the base of reservoir sleeve 30 is annular retaining recess 33. This slight indentation or recess formed into the base of the exterior surface of the reservoir sleeve neck 37 prevents the snuffing bowl 20 from sliding along the sleeve unless the entire chafing dish fuel canister assembly 10 is overturned a full 90 degrees. Annular retaining recess 33 provides a means for retaining the snuffing bowl in a downward position so as not to interfering with the flame produced by wick 50. Reservoir sleeve 30 additionally has reservoir 32 formed at the upper portion thereof through which wick 50 extends and defined by circular side walls 30 of the reservoir sleeve. During the burning of the combustible material 60, capillary action of the wick and burning fluid causes excess combustible fluid which is not burned to pool around the upper exposed portion of wick 50. Reservoir 32, formed by the increase in diameter of reservoir sleeve 30 as compared to reservoir neck portion 37, provides an area for said excess combustible material to pool instead of allowing the fluid to drip down the side of the wick sleeve.

Shoulder portion 31 of the reservoir sleeve forms an upper stopping point for the sliding action of the snuffing bowl 20. Snuffing bowl 20 has formed at the bottom portion thereof an opening 55, shown in FIG. 5, which has a diameter large enough to readily slide along reservoir neck portion 37 but not large enough to fit over reservoir sleeve shoulder 31. Again, as noted above, annular recess 33 is provided and formed within reservoir sleeve neck portion 37 at the lower proximity to hold the snuffing bowl 20 in place while the chafing dish fuel canister 10 is not in the overturned position. Thus if canister 10 is jarred slightly, snuffing bowl 20 remains in a downward position preventing premature extinguishment of the flame.

Figure 4:
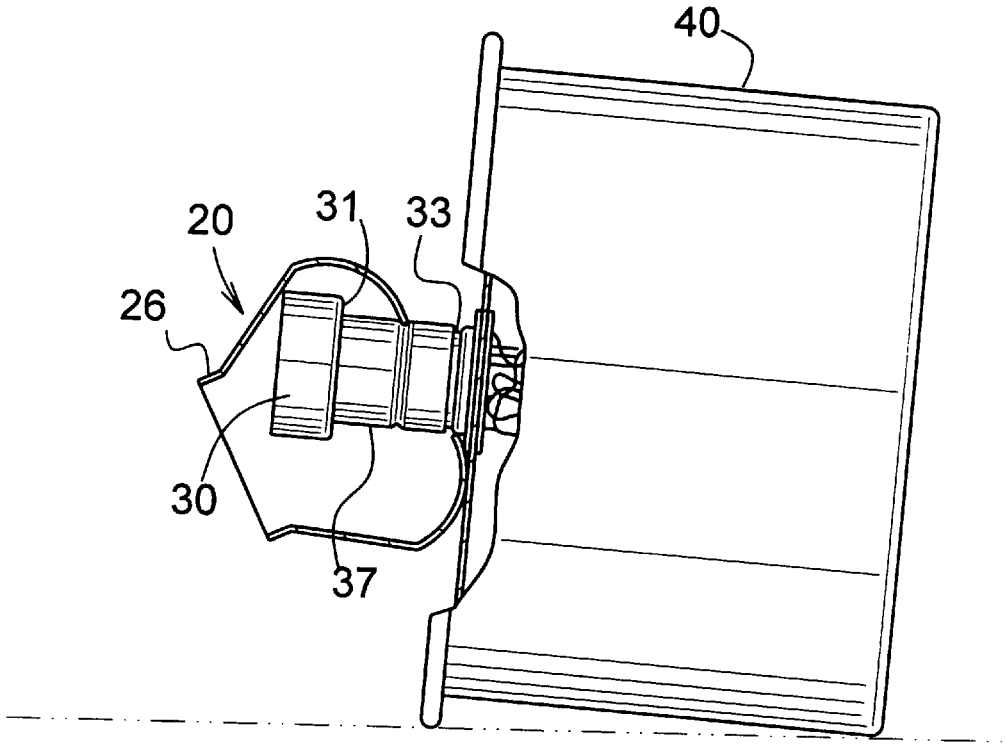
FIG. 4 is a side view of the chafing dish fuel canister of the present invention overturned.
Figure 5:
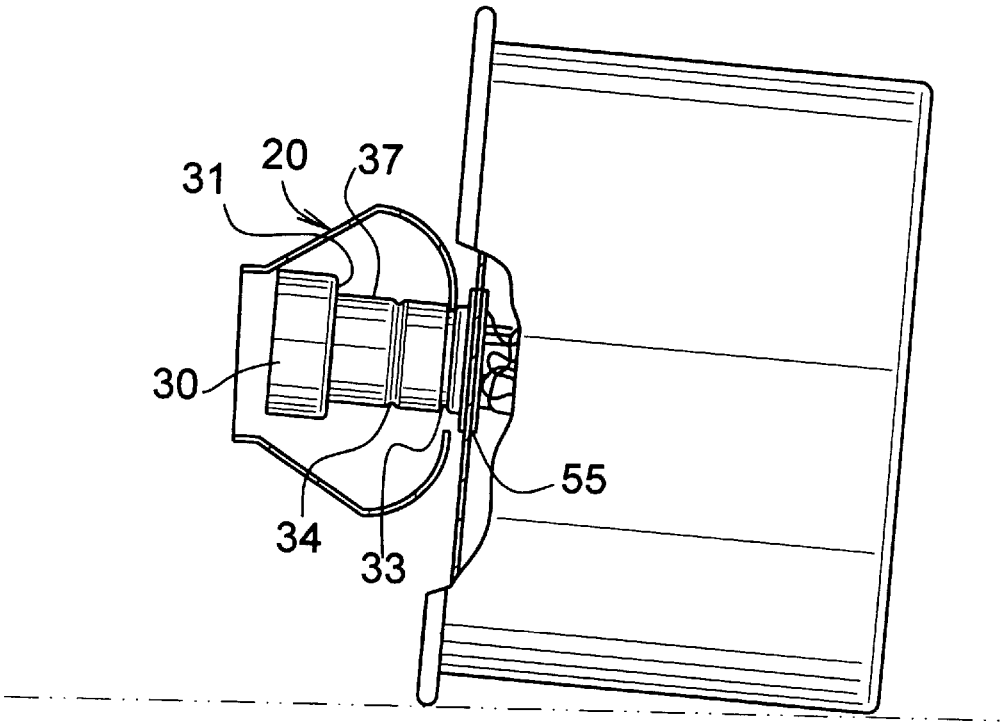
FIG. 5 is an additional side view of the chafing dish fuel canister of the present invention overturned; and, FIG. 6 is a side view of the chafing dish fuel canister of the present invention overturned.
Figure 6:
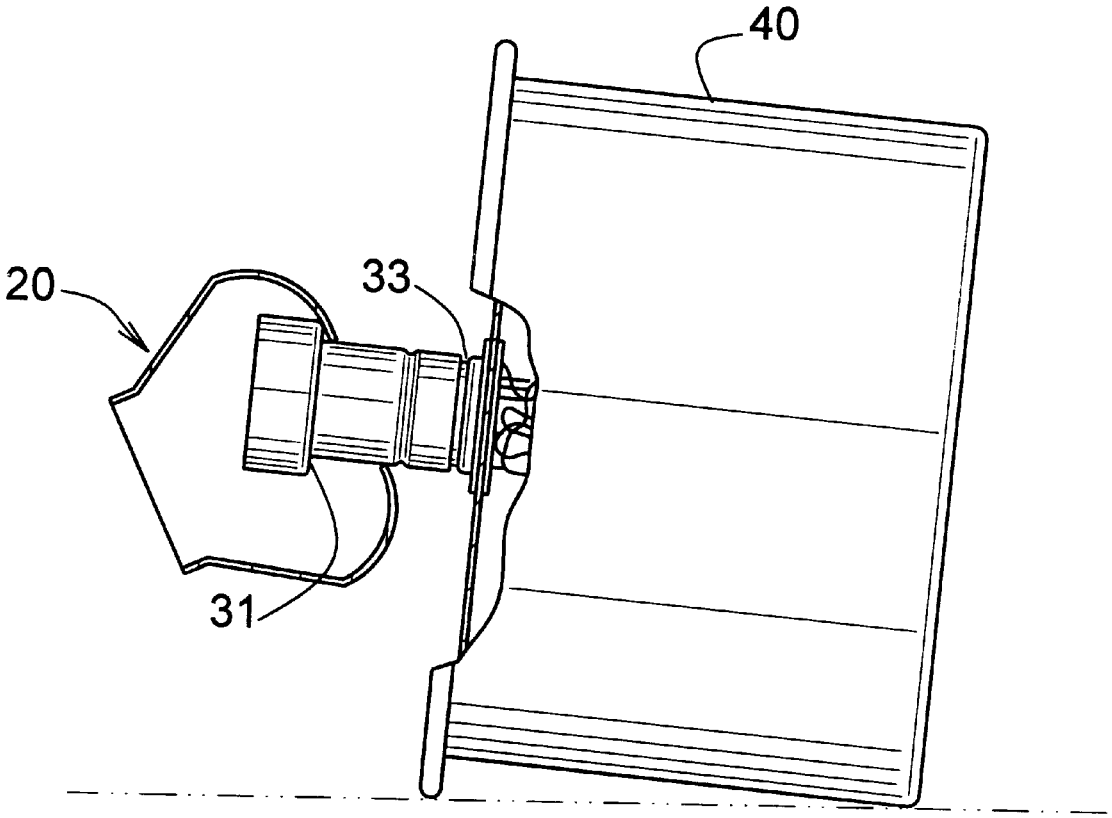

Snuffing bowl 20 is comprised of several sections which enable the snuffing bowl to properly extinguish the flame emitted by the wick 50. Snuffing bowl 20 has formed at the bottom portion thereof opening 55, shown in FIG. 5, for sliding along reservoir sleeve neck portion 37. Extending upwards from opening 55 is rounded bottom portion 25. Rounded portion 25 extends outwardly the diameter of the snuffing bowl 20 to provide for adequate interior volume for proper extinguishment of the flame. Extending upwards from the rounded bottom portion 25 of the snuffing bowl is conical portion 24 which provides adequate vertical height extension of the snuffing bowl. At the uppermost rim of the snuffing bowl is formed snuffing bowl vertical rim portion 26 which extends vertically and provides smooth vertical surface so that the snuffing bowl is not hindered when the chafing dish fuel canister is overturned. When the fuel canister 10 is overturned, the snuffing bowl itself is prevented from coming into contact with the wick 50 due to the design of vertical rim portion 26. If the vertical rim portion 26 were not provided at the uppermost section of the snuffing bowl, the angled nature of the conical section would prevent the smooth sliding of the snuffing bowl 20 along reservoir sleeve 30 because the wick may come into contact with the bowl 20. The upper section of the snuffing bowl 20 may be prevented from completely covering the wick 50 as is required to fully extinguish the flame emitted therefrom because the upper edge may come into contact with the wick and prevent the sliding action of the snuffing bowl 20 along sleeve 37. Vertical rim portion 26 prevents such hindrance by providing a upwardly extending wall which readily slides over the top of the wick 50 and along the exterior of sleeve 30 when the can 10 is overturned. Working in conjunction with this action, aperture 55 slides along lower neck portion 37, both of which combine to allow the snuffing bowl 20 to readily slide along neck 37 and extinguish a flame when the fuel canister is overturned, as is shown in FIG. 6. This full covering of the wick 50 to extinguish the flame is clearly shown in FIG. 6. As is shown in FIG. 4 or 5, if the snuffing bowl 20 were prevented from fully extending over the wick, a small portion of the flame may be allowed to continue to burn thereby causing a spill or other hazard. Therefore, the vertical rim portion 26 allows the snuffing bowl to slide down the neck portion 37 of the reservoir sleeve without contact of the bowl 20 against the wick 50 and along the rim portion 30 for adequate sliding action.

Figure 2:
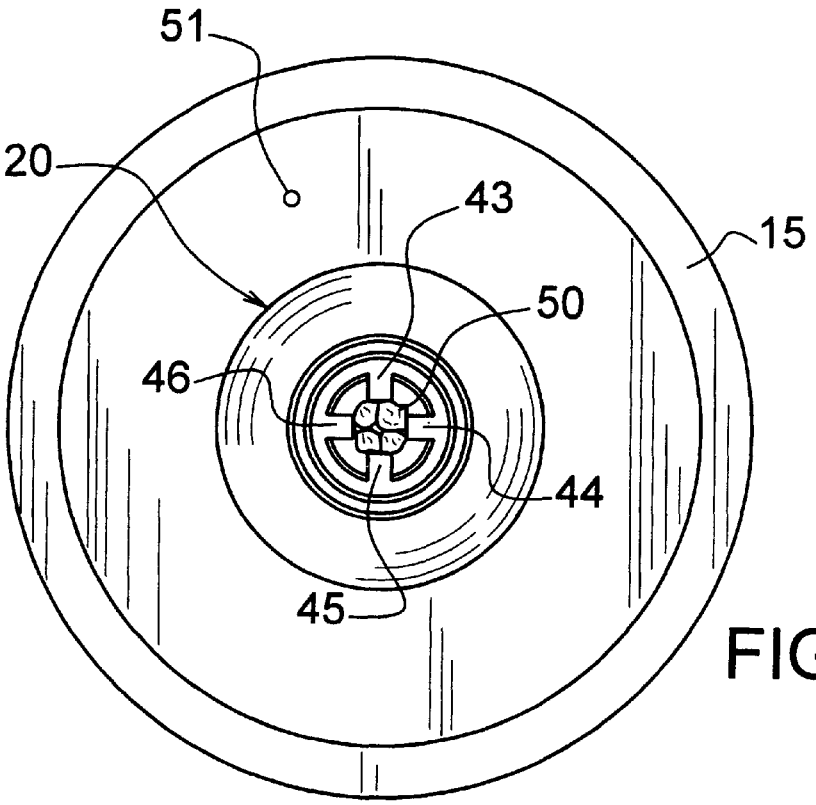
FIG. 2 is a top view of the chafing dish fuel canister of the present invention.

As shown in FIG. 2, venting hole 51 is provided to allow for proper venting of canister 40 and pressure equalization after lid 15 is secured thereon. As the fuel burns at wick 50, the level of combustible fluid within canister 40 lowers accordingly. In order to allow for proper pressure release within the canister as the level of fluid slowly lowers, venting hold 51 provides an access point for air to enter into the canister. Prior to use of the chafing fuel dish 10, tape or other removable cover is place over the venting hole 15 to prevent fluid 60 from spilling out of the canister. Prior to use, the tape is removed to properly vent the canister 40 during burning of the fluid 60.

Chafing fuel dish 10 in use is filled with appropriate combustible material, typically diethylene glycol ("DEG") which burns for approximately 6 hours and fills canister 40. During burning of the combustible fluid 60, a flame burns within reservoir 32 ignited by fuel 60 drawn upwards along wick 50. After long periods of use, excess fluid which is drawn upwards by capillary action from the can 40 may not be burned. This excess fluid, instead of running down the side of the wick sleeve as in prior art devices, collects within reservoir 32 bounded by reservoir sleeve walls 30 and allows the fluid to either be burned off by the flame emitted from the wick 50 or drain back downward into the canister through interior sleeve 35.

The snuffing action of snuffing bowl 20 is shown in FIGS. 4, 5 and 6. In FIG. 5, annular retaining recess 33 partially holds bowl 20 in place. If fuel dish 10 is slightly jarred or knocked, as may happen during transport of the chafing dish, annular retaining recess 33 prevents the snuffing bowl from covering the flame thereby preventing premature extinguishing of the flame emitted by wick 50. Shown in FIG. 4, bowl 20 is partially moved forward in extinguishing action. This partial advancement of the snuffing bowl 20 may leave the wick 50 burning and not fully extinguish the flame. FIG. 6 shows the snuffing bowl 20 fully extended along reservoir neck 37 and stopped by shoulder 31. Vertical rim portion 26 of snuffing bowl 20 prevents contact of the snuffing bowl with the wick 50 when the canister is overturned allowing proper extinguishment of the flame.

An additional enhancement of vertical rim portion 26 is proper sealing of the wick 50 and reservoir area 26 during shipping by providing a flat vertical surface to seal with a cap or other sealing means. During shipping, as there are two vertical wall portions to contact in order to seal, those being vertical rim portion 26 of snuffing bowl 20 and also reservoir wall 30, a plastic cap can securely close the entire wick and reservoir portion of the fuel canister 10 and prevent any spilling of combustible fluid 60.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What is claim is:

1. A chafing dish fuel canister, comprising:

a canister having an upper annular rim;

a canister lid securely affixed to said upper annular rim of said canister, an inner sleeve extending upward from said canister lid;

an outer sleeve extending upward from said canister lid over said inner sleeve;

a snuffing bowl slidably attached to said outer sleeve and able to slide vertically thereon;

a wick extending upward through said canister lid, said inner sleeve and said outer sleeve wherein said snuffing bowl has a rounded bottom portion, an upwardly extending conical portion and a vertical rim portion.

2. The canister of claim 1 wherein said vertical rim portion of said snuffing bowl has a diameter greater than the diameter of the uppermost portion of said outer sleeve such that there is a space between said vertical rim portion and said outer sleeve.

3. A chafing dish fuel canister, comprising:

a canister having an upper annular rim;

a canister lid securely affixed to said upper annular rim of said canister;

an inner sleeve extending upward from said canister lid;

an outer sleeve extending upward from said canister lid over said inner sleeve;

a snuffing bowl slidably attached to said outer sleeve and able to slide vertically thereon;

a wick extending upward through said canister lid said inner sleeve and said outer sleeve wherein said outer sleeve is further comprised of a cylindrical neck portion and a reservoir sleeve, said reservoir sleeve having a wider diameter than said cylindrical neck portion.

4. The canister of claim 3 wherein said outer sleeve has an annular recess at its lowermost position.

5. The canister of claim 3 wherein said snuffing bowl has an aperture formed on the bottom thereof, said aperture having a predetermined diameter less than the diameter of said reservoir sleeve.

6. A chafing dish fuel canister, comprising:

a canister having an upper annular rim;

a canister lid securely affixed to said upper annular rim of said canister, said canister lid having a venting hole therethrough and further having an aperture centrally formed thereon;

an inner sleeve extending upward through said aperture in said canister lid and securely attached thereto;

an outer sleeve having a neck portion, said neck portion extending upward over said inner sleeve and crimped thereto, said outer sleeve having above said neck portion a reservoir;

a snuffing bowl slidably mounted on said outer sleeve and vertically slidable thereon; and a wick extending upward through said canister lid, said inner sleeve and said outer sleeve.

7. The canister of claim 6 wherein said outer sleeve is further comprised of a shoulder between said reservoir and said neck portion.

8. The canister of claim 6 further comprising a plurality of prongs extending inward from said inner sleeve.

9. The canister of claim 6 wherein said snuffing bowl has a rounded bottom portion, an upwardly extending conical portion and a vertical rim portion.

10. The canister of claim 9 wherein said vertical rim portion has a diameter greater than said reservoir thereby forming a space therebetween.

11. The canister of claim 6 wherein said outer sleeve extends upward along said inward sleeve and forms an annular retaining recess thereon.

12. A chafing dish fuel canister, comprising:

a canister having an upper annular rim;

a canister lid securely affixed to said upper annular rim of said canister, said canister lid having a venting hole therethrough and further having an aperture centrally formed thereon;

an inner sleeve extending upward through said aperture in said canister lid and securely attached thereto;

an outer sleeve having a neck portion, said neck portion extending upward over said inner sleeve and crimped thereto, said outer sleeve having above said neck portion a reservoir;

a snuffing bowl slidably mounted on said outer sleeve and vertically slidable thereon;

a wick extending upward through said canister lid, said inner sleeve and said outer sleeve; and, wherein said outer sleeve is further comprised of a shoulder between said reservoir and said neck portion.

* * * * *